US005412411A

United States Patent [19]

Anderson

[11] Patent Number: 5,412,411

[45] Date of Patent: May 2, 1995

[54] CAPPING STATION FOR AN INK-JET PRINTER WITH IMMERSION OF PRINTHEAD IN INK

[75] Inventor: David G. Anderson, Ontario, N.Y.

[73] Assignee: Xerox Corporation, Stamford, Conn.

[21] Appl. No.: 157,455

[22] Filed: Nov. 26, 1993

[51] Int. Cl.[6] ..... B41J 2/165

[52] U.S. Cl. ..... 347/28; 347/29; 347/84; 347/93

[58] Field of Search ..... 346/75, 1.1, 140 R; 347/22, 26, 28, 29, 30, 84, 85, 93

[56] References Cited

U.S. PATENT DOCUMENTS

| | | | |
|---|---|---|---|
| 3,737,914 | 6/1973 | Hertz | 346/75 |
| 3,839,721 | 10/1974 | Chen et al. | 346/75 |
| 4,228,442 | 10/1980 | Krull | 346/140 |
| 4,296,418 | 10/1981 | Yamazaki et al. | 346/75 |
| 4,318,114 | 3/1982 | Huliba | 346/140 |
| 4,364,065 | 12/1982 | Yamamori | 346/140 |
| 4,626,869 | 12/1986 | Piatt | 346/140 R X |
| 4,734,706 | 3/1988 | Le et al. | 346/1.1 |
| 4,734,719 | 3/1988 | Suzuki | 346/140 |
| 4,893,137 | 1/1990 | Ebinuma et al. | 346/140 R X |
| 4,916,468 | 4/1990 | Hayamizu | 346/140 R |
| 4,961,076 | 10/1990 | Cowger | 346/1.1 |
| 5,040,000 | 8/1991 | Yokoi | 346/140 R |
| 5,051,761 | 9/1991 | Fisher et al. | 346/140 R |

*Primary Examiner*—Benjamin R. Fuller
*Assistant Examiner*—John E. Barlow, Jr.
*Attorney, Agent, or Firm*—R. Hutter

[57] ABSTRACT

A capping and maintenance station for an ink-jet printer provides immersion of a printhead into a supply of ink of the same type as emitted by the printhead, when the printhead is not in use. The immersion provides cleaning and priming, and prevents drying of ink within the printhead.

13 Claims, 1 Drawing Sheet

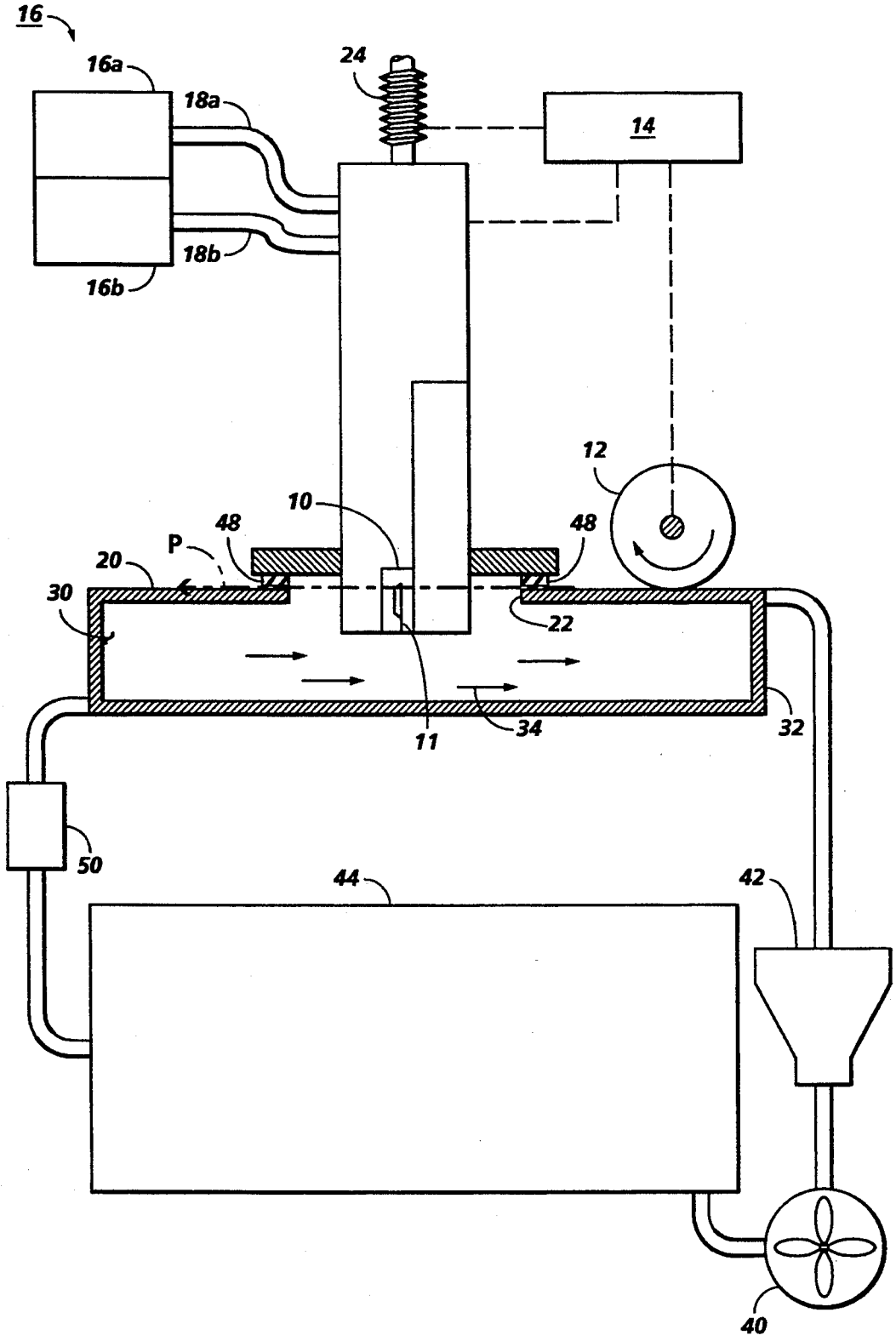
16
16a
18a
24
14
18b
16b
12
10
48
48
P
20
30
22
11
34
32
50
44
42
40

CAPPING STATION FOR AN INK-JET PRINTER WITH IMMERSION OF PRINTHEAD IN INK

The present invention relates to ink-jet printing, and is more particularly concerned with an effective capping and maintenance device for a full-width array ink-jet printhead.

In existing thermal ink jet printing, the printhead typically comprises one or more ink ejectors, such as disclosed in U.S. Pat. No. 4,463,359, each ejector including a channel communicating with an ink supply chamber, or manifold, at one end and having an opening at the opposite end, referred to as a nozzle. A thermal energy generator, usually a resistor, is located in each of the channels, a predetermined distance from the nozzles. The resistors are individually addressed with a current pulse to momentarily vaporize the ink and form a bubble which expels an ink droplet. As the bubble grows, the ink rapidly bulges from the nozzle and is momentarily contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separation of the bulging ink as a droplet. The acceleration of the ink out of the nozzle while the bubble is growing provides the momentum and velocity of the droplet in a substantially straight line direction towards a print sheet, such as a piece of paper. Because the droplet of ink is emitted only when the resistor is actuated, this type of thermal ink-jet printing is known as "drop-on-demand" printing. Other types of ink-jet printing, such as continuous-stream or acoustic, are also known.

In a single-color ink jet printing apparatus, the printhead typically comprises a linear array of ejectors, and the printhead is moved relative to the surface of the print sheet, either by moving the print sheet relative to a stationary printhead, or vice-versa, or both. In some types of apparatus, a relatively small printhead moves across a print sheet numerous times in swaths, much like a typewriter; alternatively, a printhead which extends the full width of the print sheet and is passed once down the print sheet to give full-page images is known as a "full-width array" (FWA) printer. When the printhead and the print sheet are moved relative to each other, imagewise digital data is used to selectively activate the thermal energy generators in the printhead over time so that the desired image will be created on the print sheet.

With any kind of ink-jet printer in which a printhead is in close and extended contact with a substrate such as a sheet of paper with partially-dried ink thereon, an important practical concern is contamination of the area around the ejectors. External debris such as lint or stray paper fibers are likely to become caught in the small gap between the front face of the printhead and the sheet, possibly entering the nozzles of the ejectors and causing a failure of ejectors. Another cause of failure of individual ejectors is the fact that, if a particular ejector is not used for an appreciable length of time, even while the system is printing a document, a "viscous plug" of partially-dried ink will, in effect, cause a clot in the particular ejector, causing the ejector to fail at least temporarily, at least until the reheating of the particular ejector softens the viscous plug. A viscous plug often creates a partial blockage of an ejector, causing an ink droplet ejected therefrom to be misdirected. In ink-jet printers, a failure of even one ejector will have conspicuous results on a print, because the plugged ejector will leave a blank stripe across a printed area where the ink from the ejector should have been placed. The failure of even a very few ejectors in a system will render the entire system unsatisfactory to a demanding user. Proper cleaning and maintenance of the area around the ejectors and between the ejectors and the substrate is therefore of crucial importance to a practical ink-jet printer.

Numerous cleaning and maintenance devices for ink-jet printheads are known in the prior art. U.S. Pat. No. 4,228,442 discloses a means for preventing drying of ink at the nozzle of an ink jet printhead. An absorbent material member is positioned to have one end disposed in a chamber containing solvent, with another end thereof directed to an area around the nozzle of the printhead.

U.S. Pat. No. 4,318,114 discloses an ink-supply system for an ink jet printer, wherein the print head operates by means of a continuous supply of ink to the printhead. The print head creates a more or less continuous flow of jet drop streams, which are selectively diverted toward a print receiving medium. Drops which are not deposited on the medium are deflected to a drop catcher and returned to the fluid supply system.

U.S. Pat. No. 4,340,897 discloses a cleaning device for an ink-jet writing head wherein the nozzles of the writing head are urged into contact with a manifold having a set of brushes thereon. Vacuum is applied through the brushes to remove excess ink from the nozzles.

U.S. Pat. No. 4,364,065 discloses a nozzle moistening device for an ink jet writing head. The moistening device includes an elastic enclosure fluid-tightly engagable with the front face of the writing head. Water is transmitted into the enclosure, to permit evaporation of the water within the enclosure to moisten the nozzle. This patent discloses, at column 1 lines 48–54, submerging the nozzle into water when the system is not in operation, but then says that the system is "unsatisfactory" in regard to printing upon resumption of the writing operation.

U.S. Pat. No. 4,546,363 discloses a nozzle cleaning device which blows a cleaning solvent against the nozzle portion of a printer head in an ink-jet printer. The ejecting unit includes a plurality of orifices, and a quantity of cleaning solvent is sprayed, by means of a piston, onto the nozzle of the printer head.

U.S. Pat. No. 4,567,494 discloses an ink-jet printer, the nozzles of which are primed and cleaned after each print line by engaging the nozzles with an elastomeric suction cup. The suction cup includes an inner cup of foam which wipes of any residual ink droplets. The cup is connected to a vacuum pump for drawing ink out of the nozzles.

U.S. Pat. No. 4,734,706 discloses an ink-jet printhead having a membrane disposed over the orifices thereof, to prevent evaporative clogging. The elastic property of the membrane permits the passage of an ink drop therethrough, followed by the closing up of the membrane.

U.S. Pat. No. 4,734,719 discloses a capping device for an ink jet printhead, wherein a pump device causes suction of liquid through the orifices of the printhead.

U.S. Pat. No. 4,746,938 discloses an ink-jet printer having a heat washing unit disposed beyond one end of the printing area. The heat washing unit includes an ink mist suction unit which sucks ink mist around the ink-jet unit and the anti-clogging unit, which prevents clogging of the nozzles.

U.S. Pat. No. 4,814,794 discloses a cleaning device for the nozzle of an ink-jet printer, wherein cleaning liquid is supplied from a bag in a disposable cartridge and sprayed on the side of a nozzle in the printhead.

U.S. Pat. No. 4,829,318 discloses a maintenance system for purging and cleaning an ink-jet printhead, including a self-aligning purge nozzle which floats into positive engagement with a vent hole of the printhead, and a wiping roller about which a tape of wiping cloth passes.

U.S. Pat. No. 4,853,717 discloses a maintenance station for an ink-jet printer comprising a pump for priming the printhead, and wiping means for cleaning the printhead. The wiper is stationary relative to the apparatus, so that when the printhead on a carriage passes across the wiper in the carriage motion, the wiper is moved across the front face of the printhead.

U.S. Pat. No. 4,961,076 discloses an ink jet pen, or cartridge, including a catchbasin coupled to the main ink reservoir, adapted to contain ink displaced from the reservoir by environmental conditions. An ink return mechanism allows the ink caught in the catchbasin to be returned to the reservoir.

U.S. Pat. No. 5,084,712 discloses a maintenance system for an ink jet printer, including a solvent supply system for spraying solvent on the faces of the ink-jets and in the ink-jet openings, and a brush for scrubbing the ink-jet faces during and immediately after the spraying process. The solvent vapors enter the jets and deprime the jets so that the ink remaining in the jets drains out back into an ink reservoir.

U.S. Pat. No. 5,184,147 discloses an ink-jet printhead maintenance system having means for applying a vacuum to the ink-jet nozzles in the printhead. An elongated wiper engages and wipes the surface of the nozzles and is preferably moved at an extremely slow rate across the surface to enhance the wiping operation. A specialized drip edge is positioned beneath the orifice surface for directing drops of ink away from the ink-jet printhead which are generated during the cleaning procedure.

According to the present invention, there is provided an ink-jet printing apparatus, comprising a printhead, having a nozzle for emitting ink in imagewise fashion. A capping station includes a supply of ink maintained therein. Means are provided for selectably disposing the printhead in a position whereby the nozzle of the printhead is immersed in the supply of ink in the capping station.

The FIGURE is an elevational view showing the basic elements of a full-width ink-jet printer, incorporating the capping and maintenance system of the present invention.

In the illustrated full-width ink-jet printer, a print sheet on which a desired image is to be printed is caused to move through the paper path marked by the dotted arrow labeled P past a printhead shown as 10, which is intended to extend the entire width of the print sheet across the direction of path P. The print sheet is caused to move through the path P by means of a friction roller shown as 12, which contacts the sheet prior to printing thereon and causes it to move past the printhead 10. Friction roller 12 is typically moved by a motor (not shown) which is controlled to move the print sheet in a continuous motion coordinated with the action of the printhead 10. Other means for moving the print sheet relative to the printhead may be provided, such as a belt vacuum system, continuous-feed perforated form system, or any other means which are familiar in the art of paper handling. Printhead 10 and friction roller 12 are controlled by a central control system indicated as 14, which may be part of the printing apparatus itself, or which may include portions, particularly software portions, which reside in a host computer separate from the printing apparatus.

As is well-known in the art of ink-jet printing, a full-width thermal ink-jet printhead such as 10 includes one or more linear arrays of ejectors 11, each ejector having a nozzle or orifice for the emission of ink therefrom. The FIGURE shows one representative ejector/nozzle 11 as would be seen when such a linear array is viewed end-on. The nozzles in the linear array are typically spaced at 300 or more per linear inch, although in a high-performance system, a resolution of 600 nozzles per inch is typically desired. As the print sheet moves past the linear array of nozzles 11 in printhead 10, individual ejectors forming the array are selectively activated to emit droplets of ink in a coordinated fashion so that a desired ink image is placed on the print sheet. The supply of ink for the the printhead 10 is shown generally as 16. In one common design of an ink-jet printer, the front face of the printhead 10 is intended to contact the print sheet, but this feature is not required for the present invention. Typically, in a high-speed full-width ink-jet printer, there is disposed downstream of the printhead 10 along the sheet path P a drying device (not shown), which typically emits microwave or other radiant energy against the surface of the print sheet in order to quickly evaporate the liquid ink placed thereon by the printhead 10.

In an alternate embodiment of the printing apparatus, printhead 10 may include a plurality of parallel linear arrays, such as for printing superimposed images of different color. These arrays in the printhead 10 may be supplied by one or more ink supply reservoirs shown generally as **16*a* and 16*b*, via ink supply conduits 18*a* and 18*b***, in a manner which is known in the art.

The sheet path P, as shown in the FIGURE, causes a sheet passing through the path to slide against a platen surface 20, which ensures proper placement and motion of the print sheet. Disposed adjacent to the face of the printhead 10 is an opening 22 defined in platen 20, the opening 22 accessing a "capping station" generally indicated as 30, which will be described in detail below.

The printhead 10 is, in the illustrated embodiment, selectably positionable in a printing position, and also in a capping position. In the printing position, the printhead 10 is so disposed that the face of printhead 10 is directly adjacent to, if not in contact with, the surface of a sheet passing through the sheet path P. When the printhead 10 is in this position, the print sheet is permitted to pass under the printhead 10, so that the ejectors in printhead 10 can create the desired ink image on the print sheet. When the printer is not in use for its printing function, however, it is intended that the printhead 10 be moved to its "capping" position. This selectable positioning of printhead 10 is carried out by means such as solenoid 24, or any other means which would be apparent to one skilled in the art, such as a gear-and-rack system, a hydraulic system, a cam system, or a stepper motor system. For most convenient operation of the printing apparatus, this solenoid 24 or other means would be controlled by control system 14, and adapted to lower the printhead 10 into the ink 34 when the printing apparatus was not in use for a significant period of time.

The capping station 30 generally includes a small tank 32 which maintains a supply of ink 34 therein. As shown in the illustrated embodiment, when printhead 10 is disposed by solenoid 24 in the capping position, the face of printhead 10, and in particular the nozzles in the face thereof, are indexed through the sheet path P and caused to be immersed in the ink 34 within tank 32 of capping station 30. The ink 34 in tank 32 is intended to be of the same type as the ink being emitted from the printhead 10. In this way, even if some ink is drawn, by capillary action, into the nozzles 11 of printhead 10, because the two inks are the same, there will be no noticeable effect when the apparatus begins its printing function.

The ink 34 in tank 32 is recirculated periodically or continuously so that the ink 34 can be used as an effective cleaning fluid for the removal of dried-ink plugs and other debris from the face and nozzles of the printhead 10. In order to use the ink 34 as a cleaning fluid without adversely effecting the performance of the entire system, a quantity of ink 34 is continuously or periodically drawn out of the tank 32, such as by pump 40, and passed through a filter generally shown as 42. This filter 42 may be of any suitable type, such as paper or plastic membrane. The purpose of the filter 42 is to remove dried-ink viscous plugs, paper fibers, and other contaminants from the ink 34 drawn from the tank 32. The filtered ink from filter 42 is then redirected into an ink reservoir 44. The ink in ink reservoir 44 is then used to replenish the ink drawn from tank 34. The motion of ink 34 within the tank 32, which is caused by this recirculation from pump 40, may also have a significant effect of cleaning and carrying away particulates from the face of printhead 10. This ink reservoir 44 may or may not have a physical connection to the ink supply 16 supplying ink to the printhead 10, although theoretically, because the two types of ink from the printhead 10 and in the tank 34 are of the same type, the ink supply for the printhead 10 and for the tank 34 may be common.

The complete immersion of the printhead nozzles in the ink, according to the present invention, obviates many of the common problems associated with ongoing maintenance of high-precision ink-jet printheads. Among these common problems are, of course, drying of the liquid ink remaining in the nozzle so that "viscous plugs" are formed as the ink dries. With complete immersion, the ink already in the nozzles will have no opportunity to evaporate. Further, the immersion allows for continuous priming of the nozzles, because if any ink escapes from the nozzles for whatever reasons, ink is drawn into the nozzles as needed by capillary action from the ink 34 in capping station 30.

There may also be provided, on either side of the printhead 10 in position corresponding to the edges of opening 22 in platen 20, a set of seals 48 which serve to contact the edges of the opening 22 in platen 20 when the printhead 10 is in the capping position. These seals 48 form an airtight seal around the printhead, and particularly over the top of the ink level within capping station 30, so as to prevent the evaporation of ink 34 from the capping station 30. In this way, if the printing apparatus happens to be dormant for a significant period of time, significant evaporation of ink within the capping station 30, which is liable to cause clogging, will be substantially avoided.

The recirculation of ink 34 through capping station 30 and ink reservoir 44 may be varied as needed to maintain a sufficient supply of filtered ink which may serve as an informal cleaning fluid for the face of printhead 10. The flow may be slow and continuous, or there may be provided a significant "flushing" routine at power-up or power-down, depending on the particular needs associated with the printing apparatus. The capacity of the tank 32 and capping station 30 need be only enough to immerse the face of printhead 10 across the array.

In order to ensure proper practical operation of such an apparatus, there may also be provided fluid-circulation devices in the recirculating ink path around the capping station 30. For example, various bubble-trapping devices (not shown), may be useful in ensuring a smooth flow of ink through the capping station 30. The operation of such bubble-trapping devices, as well the general cleaning function of the capping station 30, may be improved by providing means such as 50 for gently heating the ink at some point along the circulation path.

If there is provided in the printing apparatus a plurality of linear arrays of nozzles 11, such as for printing different colors from different arrays substantially simultaneously, a problem will exist of one array adapted for the printing of one particular color being possibly immersed in a supply of ink of another color. This may cause undesirable mixing of different types of inks within the nozzles. In order to avoid this problem, one possible technique is to provide separate but adjacent tanks 32 within a single capping station 30, so that each linear array is immersed into an ink 34 of the matching color. Another possibility is to provide, instead of ink for the ink 34 in capping station 30, a preferably colorless liquid, which substantially comprises a common solvent for all the different types of ink emitted from printhead 10. In the case of water-based inks, for example, a likely choice would be to circulate water through capping station 30.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

I claim:

1. An ink-jet printing apparatus, comprising:

a printhead having a nozzle for emitting ink in imagewise fashion;

a capping station having a supply of ink maintained therein;

a pump adapted to continuously draw ink from the capping station and replenish ink into the capping station, with an effect of circulating the supply of ink maintained in the capping station, the circulation of ink removing particulates from the printhead and conveying the particulates out of the capping station; and means for selectably disposing the printhead in a position to immerse the nozzle of the printhead in the supply of ink in the capping station.

2. The printing apparatus of claim 1, further comprising means for filtering the supply of ink in the capping station.

3. The printing apparatus of claim 1, further comprising means external to the printhead for heating the supply of ink in the capping station.

4. The printing apparatus of claim 1, wherein the disposing means selectably disposes the printhead in a position for emitting ink from the nozzle onto a print sheet.

5. The printing apparatus of claim 4, further comprising means for moving the sheet relative to the printhead through a sheet path adjacent the nozzle 6. The printing apparatus of claim 5, wherein the capping station is disposed adjacent the nozzle on a side of the sheet path opposite the nozzle.

7. The printing apparatus of claim 5, wherein the disposing means is adapted to selectably dispose the printhead in a first position for emitting ink from the nozzle onto the sheet, and in a second position whereby the nozzle of the printhead is immersed in the supply of ink in the capping station, and wherein the disposing means moves the printhead from the first position to the second position across the sheet path.

8. The printing apparatus of claim 7, further comprising a seal operatively attached to the printhead, the seal being so configured as to prevent ink from escaping from the capping station when the printhead is in the second position.

9. An ink-jet printing apparatus, comprising:

a printhead having a nozzle for emitting an ink including a liquid solvent;

a capping station having a supply of liquid solvent maintained therein;

a pump adapted to continuously draw liquid solvent from the capping station and replenish liquid solvent into the capping station, with an effect of circulating the supply of liquid solvent maintained in the capping station, the circulation of liquid solvent removing particulates from the printhead and conveying the particulates out of the capping station; and means for selectably disposing the printhead in a position to immerse the nozzle of the printhead in the supply of liquid solvent in the capping station.

10. The printing apparatus of claim 9, wherein the printhead emits a plurality of inks including a common liquid solvent.

11. The printing apparatus of claim 10, further comprising means for moving a sheet relative to the printhead through a sheet path adjacent the nozzle.

12. The printing apparatus of claim 11, wherein the disposing means is adapted to selectably dispose the printhead in a first position for emitting ink from the nozzle onto the sheet, and in a second position whereby the nozzle of the printhead is immersed in the supply of liquid in the capping station, and wherein the disposing means moves the printhead from the first position to the second position across the sheet path.

13. The printing apparatus of claim 12 further comprising a seal operatively attached to the printhead, the seals being so configured as to prevent ink from escaping from the capping station when the printhead is in the second position.

* * * * *